US009073168B2

(12) United States Patent
Cheng

(10) Patent No.: US 9,073,168 B2
(45) Date of Patent: Jul. 7, 2015

(54) ECCENTRIC SEAT FOR AN AUTOMOBILE GRINDING MACHINE

(71) Applicant: Ming-Ta Cheng, Taichung (TW)

(72) Inventor: Ming-Ta Cheng, Taichung (TW)

( * ) Notice: Subject to any disclaimer, the term of this patent is extended or adjusted under 35 U.S.C. 154(b) by 232 days.

(21) Appl. No.: 13/734,472

(22) Filed: Jan. 4, 2013

(65) Prior Publication Data

US 2014/0194040 A1 Jul. 10, 2014

(51) Int. Cl.
*B24B 23/02* (2006.01)
*B24B 23/04* (2006.01)

(52) U.S. Cl.
CPC ..... *B24B 23/04* (2013.01)

(58) Field of Classification Search
CPC ..... B24B 23/02; B24B 23/03; B24B 23/04; B24B 41/04; B24B 23/005
USPC ..... 451/357, 359, 270, 271, 360
See application file for complete search history.

(56) References Cited

U.S. PATENT DOCUMENTS

| | | | | |
|---|---|---|---|---|
| 2,794,303 | A * | 6/1957 | Wickes | 451/357 |
| 5,823,862 | A * | 10/1998 | Heidelberger | 451/344 |
| 6,485,360 | B1 * | 11/2002 | Hutchins | 451/357 |
| 6,974,370 | B2 * | 12/2005 | Hutchins | 451/357 |
| 7,128,641 | B1 * | 10/2006 | Lin | 451/359 |

* cited by examiner

*Primary Examiner* — Robert Rose
(74) *Attorney, Agent, or Firm* — Maier & Maier, PLLC

(57) ABSTRACT

An eccentric seat of an automobile grinding machine has a base, a grinding device, and a linking-fixing unit. The base has a base hole formed in the base. The grinding device is mounted in the base and has a grinding head. The grinding head has a head hole aligned with the base hole. The linking-fixing unit is mounted in the base hole and can move along the axial direction of the base hole and can be engaged the base. The linking-fixing unit has an inserting end that can be engaged in the head hole. When the inserting end is inserted into the head hole, the grinding head is fixed relative to the base, such that it is easy for the grinding head to combine with a grinding body, and the eccentric seat is suitable for polishing a surface of an automobile.

9 Claims, 9 Drawing Sheets

ECCENTRIC SEAT FOR AN AUTOMOBILE GRINDING MACHINE

BACKGROUND OF THE INVENTION

1. Field of the Invention

The present invention relates to an eccentric seat, especially for an eccentric seat for an automobile grinding machine used for polishing or waxing an outer surface of an automobile.

2. Description of Related Art

An eccentric seat is mounted on a front end of an automobile grinding machine, such that the automobile grinding machine polishes or waxes an outer surface of an automobile with the eccentric seat.

With reference to FIG. 9, the conventional eccentric seat comprises a base 60 and a grinding device 70. The base 60 comprises a base space 61 and two base holes 62. The base space 61 is formed inside the base 60. The base holes 62 are formed in the base 60 at two opposite sides respectively and communicate with the base space 61. The grinding device 70 comprises a bearing 71 and a grinding head 72. The bearing 71 is mounted in the base space 61 and an outer wall of the bearing 71 abuts an inner wall of the base 60. The grinding head 72 is mounted in the bearing 71 and abuts an inner wall of the bearing 71. The grinding head 72 comprises a linking hole 721 formed in an end of the grinding head 72, and the linking hole 721 can align with the base holes 62.

In use, the base 60 is combined with a grinding machine, and the grinding head 72 is connected with a grinding body. Because the end of the grinding head 72 in which the linking hole 721 is defined is free for rotation, to connect the grinding body with the grinding head 72 requires a fixing stick 80. The fixing stick 80 is inserted into the base holes 62 and the linking hole 721 in order to fix the grinding head 72 relative to the base 60, such that the end of the grinding head 72 in which the linking hole 721 is defined is made non-free for rotation, and then the grinding body can be assembled on the grinding head 72 easily. The fixing stick 80 must be removed when the eccentric seat is rotating for polishing or waxing an automobile in order to prevent the fixing stick 80 from being thrown off from the linking hole 721 and the base holes 62. However, the fixing stick 80 must be inserted into the base holes 62 and the linking hole 721 again when the grinding body is to be replaced, and it is inconvenient for use.

On the other hand, when the grinding machine combined with the base 60 is powered on, the base 60 rotates by the grinding machine and drives the grinding head 72 to rotate by the bearing 71. The grinding body connected with the grinding head 72 will be used to polish or wax an outer surface of an automobile. Because the grinding head 72 is driven to rotate only by the bearing 71 and the centrifugal force, a friction between the grinding body and the outer surface of an automobile will slow down a speed of rotation of the grinding head 72. As a result, the conventional eccentric seat is suitable only for waxing an automobile but not for polishing an automobile.

SUMMARY OF THE INVENTION

The main object of the present invention is to provide an eccentric seat for an automobile grinding machine, which comprises a base, a grinding device, and a linking-fixing unit.

The base has a base body, a base space, and a base hole. The base body has a longitudinal direction. The base space is formed along the longitudinal direction of the base body. The base hole is formed in the base body and communicates with the base space and comprises an axial direction.

The grinding device is inserted into the base space and comprises a bearing mounted in the base space and abutting the base body and a grinding head mounted in and abutting the bearing. The grinding head has an end and a head hole formed radially in the end of the grinding head and selectively aligned with the base hole.

The linking-fixing unit is inserted into the base hole moveably along the axial direction of the base hole and is engaged the base and comprises an inserting end inserted into the head hole and a pulling end opposite to the inserting end.

The linking-fixing unit is moveably mounted in the base hole. The inserting end can be inserted into and engage the head hole, such that the grinding head corresponding to the head hole is non-free for rotation. The grinding head is fixed relative to the base. As a result, it is easy for the eccentric seat to combine a grinding body to the grinding head, and the grinding head is driven to rotate by the linking-fixing unit, such that the eccentric seat is suitable for polishing a surface of an automobile.

DETAILED DESCRIPTION OF PREFERRED EMBODIMENT

Figure 1:
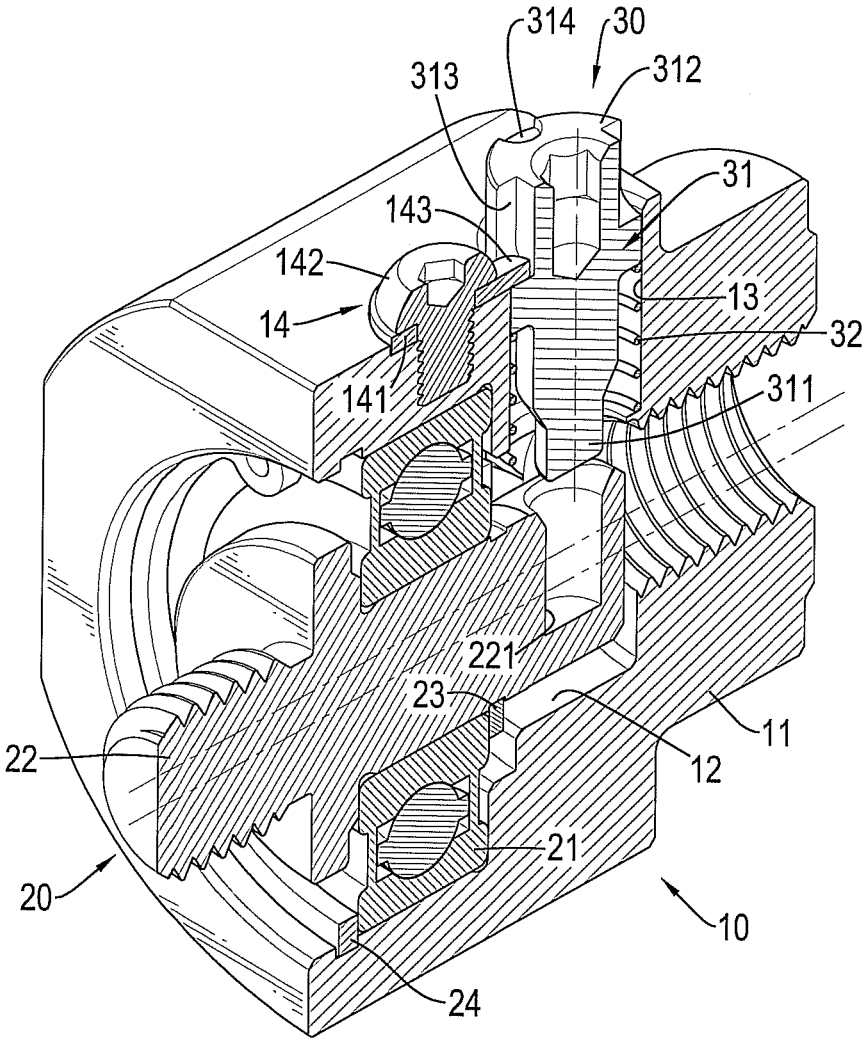
FIG. 1 is a perspective view in partial section of a first preferred embodiment of an eccentric seat for an automobile grinding machine in accordance with the present invention.
Figure 2:
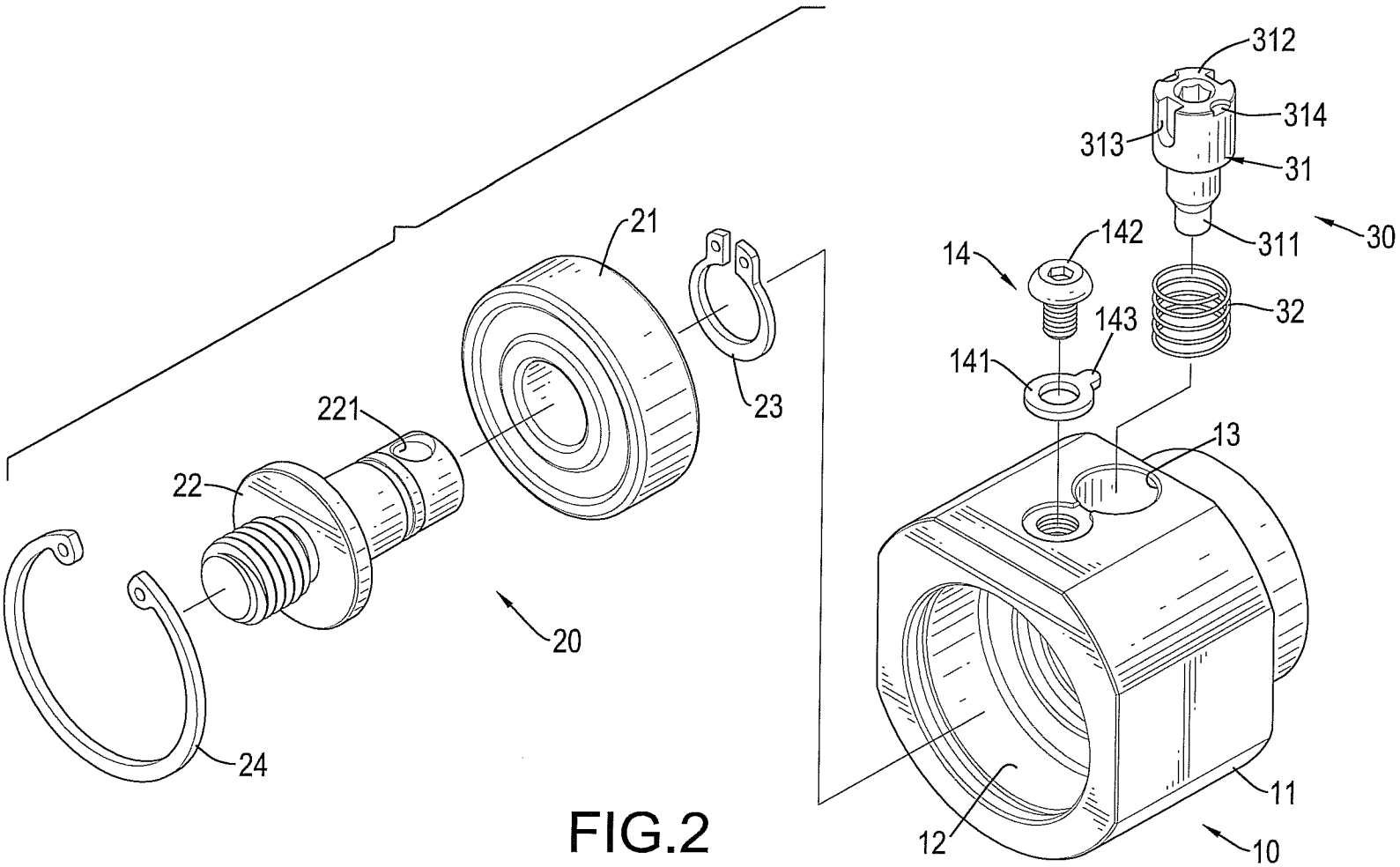
FIG. 2 is an exploded perspective view of the eccentric seat in FIG. 1.

With reference to FIG. 1 and FIG. 2, a first preferred embodiment of an eccentric seat for an automobile grinding machine in accordance with the present invention comprises a base 10, a grinding device 20, and a linking-fixing unit 30.

The base 10 comprises a base body 11, a base space 12, a base hole 13, and an engaging unit 14. The base body 11 comprises a longitudinal direction, and the longitudinal direction is in eccentric relation to an axial direction of the base 10. The base space 12 is foamed along the longitudinal direction of the base body 11. The base hole 13 is formed in the base body 11 and communicates with the base space 12. The engaging unit 14 is mounted on the base body 11 and part of the engaging unit 14 protrudes into the base hole 13. Preferably, the engaging unit 14 comprises an engaging plate 141 and a bolt 142. The engaging plate 141 is fixed on the base body 11 by the bolt 142. The engaging plate 141 comprises a protrusion portion 143 protruding into the base hole 13.

The grinding device 20 is inserted into the base space 12 and is in eccentric relation to the axial direction of the base 10, such that when the base 10 is rotated, a centrifugal force will drive the grinding device 20 to rotate relative to the base 10. The grinding device 20 comprises a bearing 21, a grinding head 22, a first buckle 23, and a second buckle 24. The bearing 21 is mounted in the base space 12 and abuts the base body 11. The grinding head 22 is inserted in the bearing 21 and abuts the bearing 21. The grinding head 22 comprises a head hole 221 formed radially in an end of the grinding head 22 and the head hole 221 can be aligned with the base hole 13. The head hole 221 is formed radially either through or non-through the grinding head 22. The first buckle 23 is mounted on the grinding head 22 and is located on a side of the bearing 21 adjacent to the head hole 221. The second buckle 24 is mounted in the base body 11 and is located on a side of the bearing 21 opposite to the head hole 221.

The linking-fixing unit 30 is inserted into the base hole 13 moveably along an axial direction of the base hole 13, and can be engaged the base 10. The linking-fixing unit 30 comprises a stick body 31 and a spring 32. The stick body 31 is inserted into the base hole 13 and abuts the protrusion portion 143. The spring 32 is mounted around the stick body 31 and abuts between the stick body 31 and the base body 11. The stick body 31 comprises an inserting end 311, a pulling end 312, two first engagement troughs 313, and two second engagement troughs 314. The inserting end 311 can be inserted into and engage the head hole 221. The pulling end 312 is opposite to the inserting end 311. The stick body 31 may be formed as a handle protruding from the pulling end 312, or may form a screw hole recessed from the pulling end 312 to connect with a wrench. Preferably, the stick body 31 forms a screw hole recessed in the pulling end 312.

The first engagement troughs 313 are elongated, are formed respectively in the stick body 31 opposite to each other and are parallel with the axial direction of the base hole 13. Each first engagement trough 313 has an engaging surface formed in the engagement trough 313 adjacent to the inserting end 311 and being able to engage the protrusion portion 143. The second engagement troughs 314 are respectively formed on the pulling end 312 opposite to each other and are able to engage the protrusion portion 143.

Figure 3:
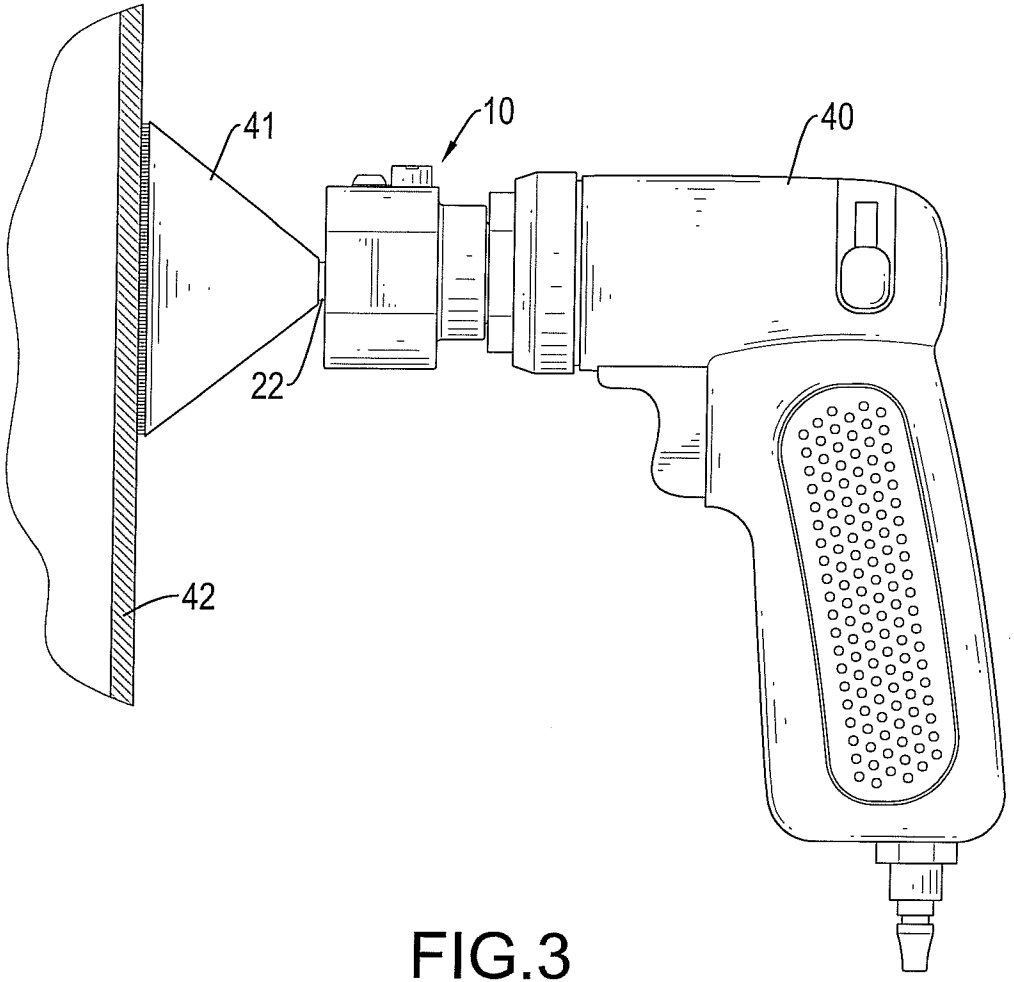
FIG. 3 is an operational side view in partial section of the eccentric seat in FIG. 1.

With reference to FIG. 1 and FIG. 3, the base 10 is connected with a grinding machine 40, and the grinding head 22 is connected with a grinding body 41. The grinding head 22 is rotated to drive the grinding body 41 to polish or wax an automobile surface 42 after the grinding machine 40 is powered on. The grinding head 22 is not fixed relative to the base 10, such that the grinding head 22 is driven to rotate only by the bearing 21 and the centrifugal force. In this situation, the eccentric seat is applied for waxing an automobile.

Figure 4:
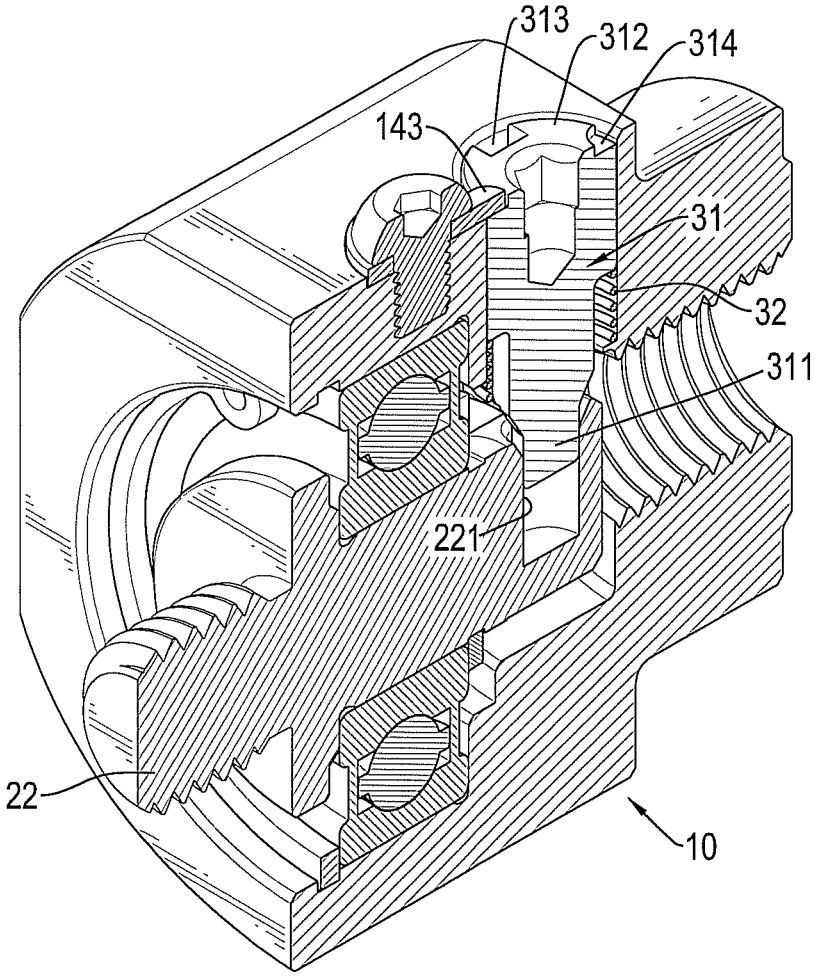
FIG. 4 is an operational perspective view in partial section of the eccentric seat in FIG. 1.

With reference to FIG. 1 and FIG. 4, a wrench is inserted into the pulling end 312 to press the stick body 31 to make the pulling end 312 below the protrusion portion 143, such that the inserting end 311 can be inserted into the head hole 221 and the stick body 31 can be rotated by the wrench. The wrench rotates the stick body 31 to make the protrusion portion 143 align with one of the second troughs 314 and then the wrench is removed from the pulling end 312. The spring 32 will spring the stick body 31 to make the second engagement trough 314 aligned with the protrusion portion 143 and engage the protrusion portion 143. By the above-mentioned means, the status of the eccentric seat is changed from FIG. 1 to FIG. 4.

With reference to FIG. 4, the inserting end 311 is inserted into the head hole 221, such that the stick body 31 fixes and links the base 10 and the grinding head 22. When the base 10 is driven to rotate by the grinding machine, the grinding head 22 is driven to rotate due to the engagement between the stick body 31 and the head hole 221. The speed of rotation of the grinding head 22 in FIG. 4 is higher than the speed of rotation of the grinding head 22 in FIG. 1. As a result, the eccentric seat is applied for polishing in this situation. On the other hand, when the original grinding body is to be replaced with another one, the grinding head 22 must be fixed and linked with the base 10 by the stick body 31, such that the end with the head hole 221 is free for rotation and the grinding head 22 is fixed relative to the base 10, and then assembling or disassembling the grinding bodies onto or from the grinding head 22 is easy and convenient.

Alternatively, the second engagement troughs 314 may be omitted and the first engagement troughs 313 may extend to the pulling end 312. When the eccentric seat is applied for polishing an automobile or for replacing grinding bodies, the stick body 31 is engaged the protrusion portion 143 by the pulling end 312.

Alternatively, each first engagement trough 313 is L-shaped and has a lateral segment formed on an end of the first engagement trough 313 opposite to the inserting end 311. When the eccentric seat is applied for waxing an automobile, the protrusion portion 143 abuts an end of one of the first engagement troughs 313 adjacent to the inserting end 311 and the inserting end 311 is not inserted into the head hole 221. When the eccentric seat is applied for polishing an automobile or replacing grinding bodies, the protrusion portion 143 abuts one of the lateral segments of one of the first engagement troughs 313 and the inserting end 311 is inserted into the head hole 221. Accordingly, the second engagement troughs 314 are optional and may be omitted, as long as the stick body 31 can be controlled to engage the head hole 221.

Figure 5:
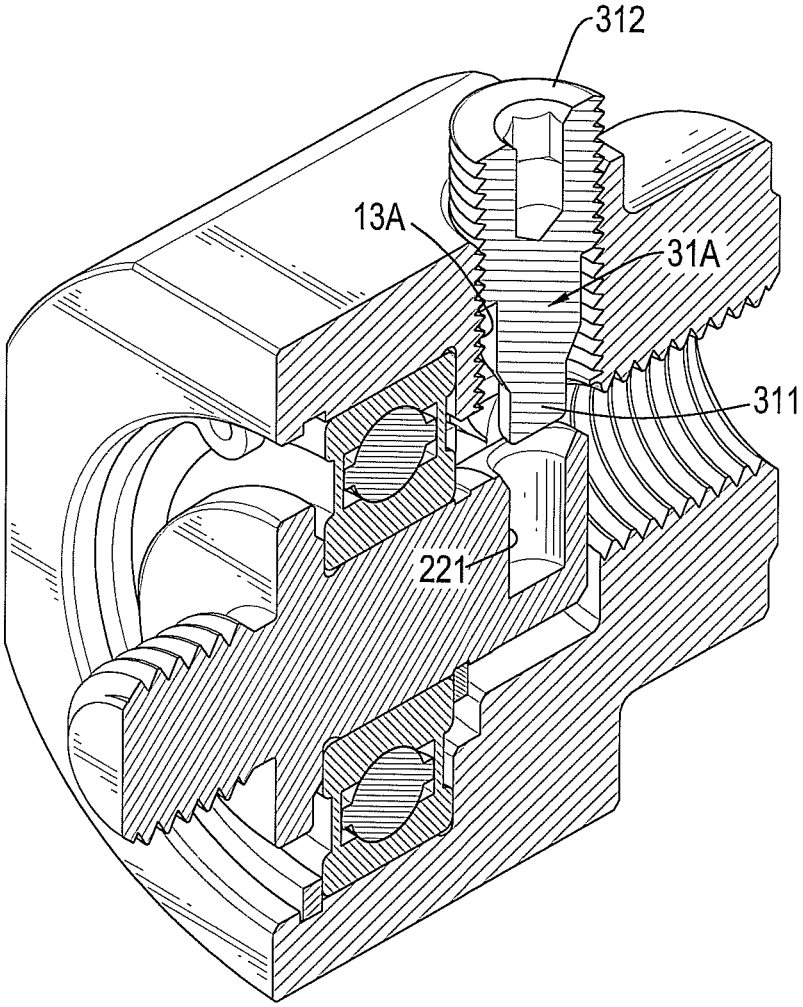
FIG. 5 is a perspective view in partial section of a second preferred embodiment of an eccentric seat for an automobile grinding machine in accordance with the present invention.

With reference to FIG. 5, the engaging unit is omitted in the second preferred embodiment. The stick body 31A is threaded with the base hole 13A. In use, a wrench is inserted into the pulling end 312 to rotate the stick body 31A to enable the inserting end 311 to engage the head hole 221.

Alternatively, the pulling end 312 is formed as a handle on the stick body 31A, such that a user can rotate the stick body 31A directly by the handle without any tool.

Figure 6:
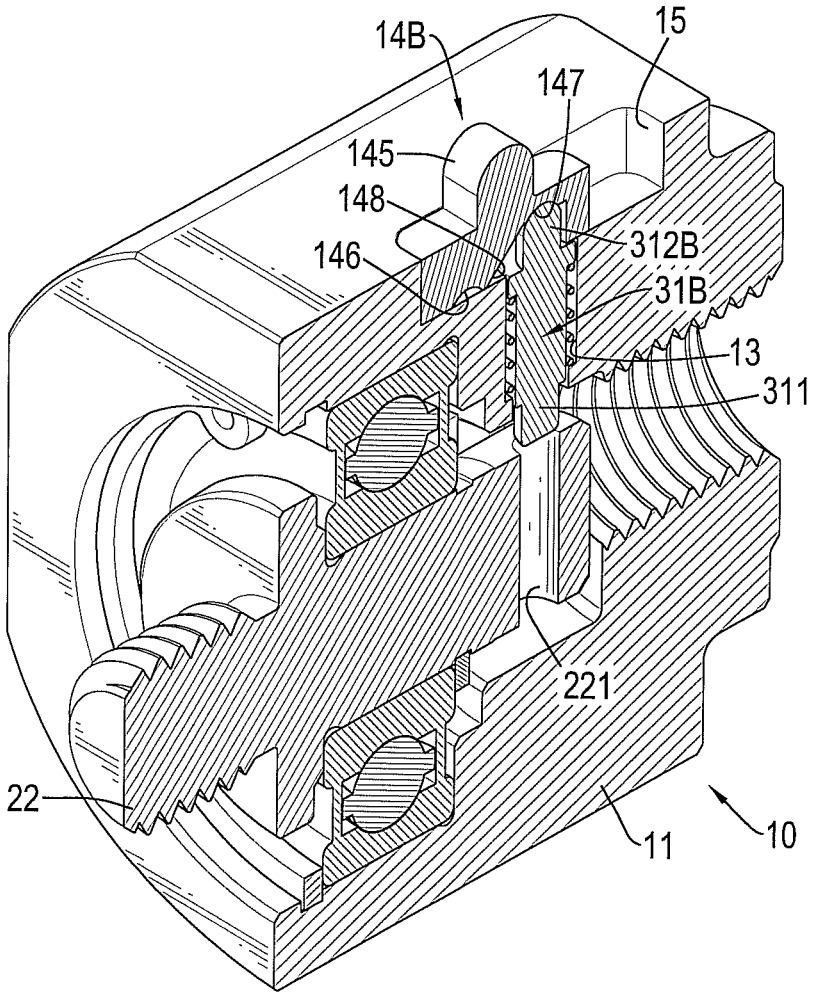
FIG. 6 is a perspective view in partial section of a third preferred embodiment of an eccentric seat for an automobile grinding machine in accordance with the present invention.
Figure 7:
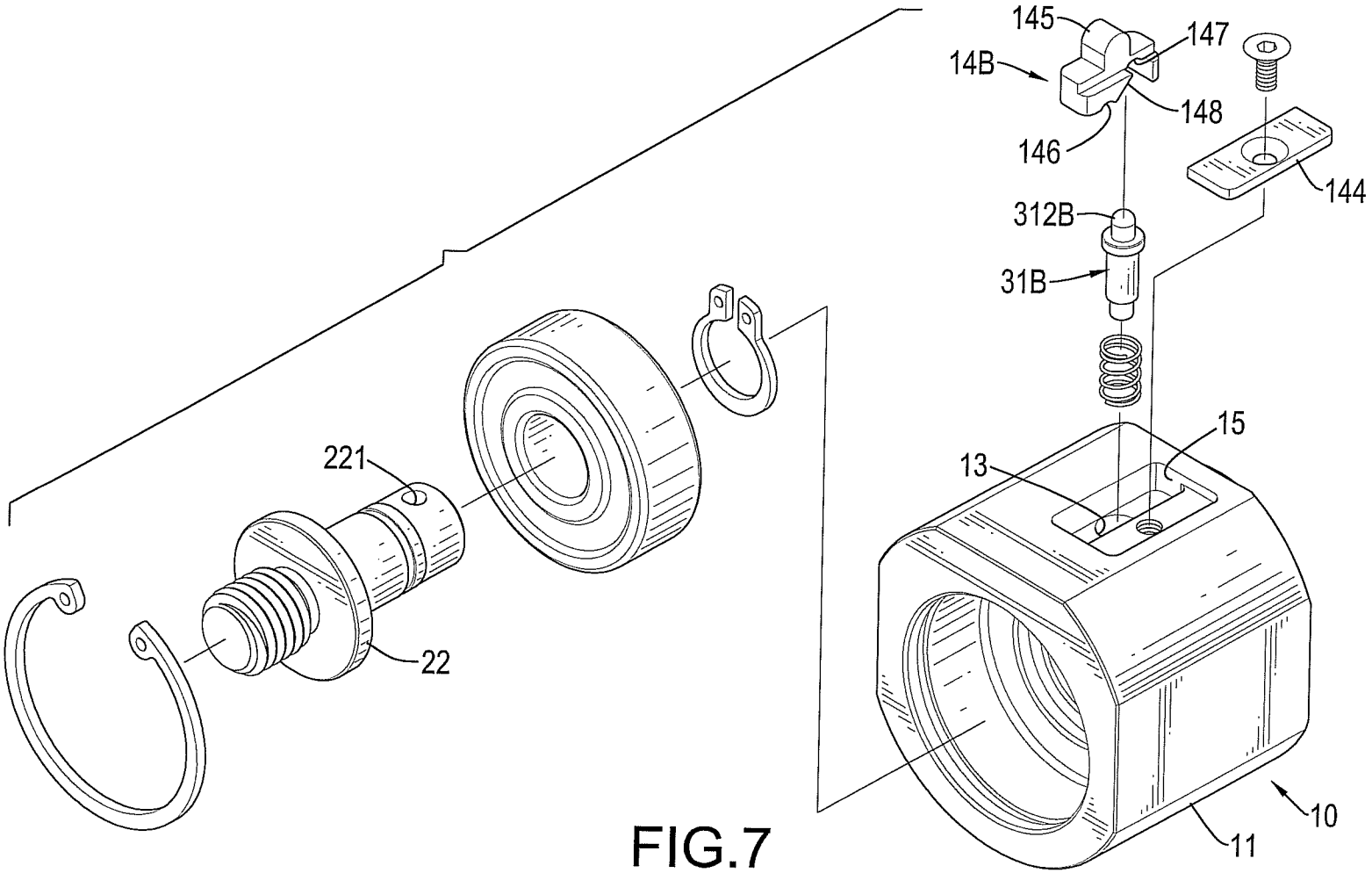
FIG. 7 is an exploded perspective view of the eccentric seat in FIG. 6.

With reference to FIG. 6 and FIG. 7, the base 10 further comprises an accommodating trough 15 formed in the base body 11 in the third preferred embodiment. The engaging unit 14B is moveably mounted in the accommodating trough 15. Preferably, the engaging unit 14B is mounted in the accommodating trough 15 by a fixing plate 144 fixed on the base body 11. The engaging unit 14B comprises a pull portion 145, a polishing-positioning portion 146, a waxing-positioning portion 147, and a sliding portion 148. The pull portion 145 protrudes from a side of the engaging unit 14B opposite to the base hole 13. The engaging unit 14B is moved by pulling the pull portion 145. The polishing-positioning portion 146 and the waxing-positioning portion 147 are recessed in a side of the engaging unit 14B facing the stick body 31B, and the polishing-positioning portion 146 and the waxing-positioning portion 147 can be aligned with the base hole 13 and press the pulling end 312B respectively. When the polishing-positioning portion 146 and the waxing-positioning portion 147 are respectively aligned with the base hole 13, a distance between the polishing-positioning portion 146 and the base hole 13 is less than a distance between the waxing-positioning portion 147 and the base hole 13. The sliding portion 148 is located in the side of the engaging unit 14B facing the stick body 31B between the polishing-positioning portion 146 and the waxing-positioning portion 147.

The polishing-positioning portion 146 and the waxing-positioning portion 147 are recessed in the engaging unit 14B. When the polishing-positioning portion 146 presses the pulling end 312B, the inserting end 311 can be inserted into the head hole 221. The sliding portion 148 is inclined because the distance between the polishing-positioning portion 146 and the base hole 13 and the distance between the waxing-positioning portion 147 and the base hole 13 are different.

Alternatively, the polishing-positioning portion 146, the waxing-positioning portion 147, and the sliding portion 148 are formed as groove structures or block structures, and the pulling end 312B is formed as a block structure or groove structure corresponding to those of the positioning portions 146,147 and sliding portion 148, such that the engaging unit 14B can be further engaged the pulling end 312B and move in the accommodating trough 15.

Alternatively, the junction between the polishing-positioning portion 146 and the sliding portion 148 and the junction between the waxing-positioning portion 147 and the sliding portion 148 are flanges respectively, such that the pulling end 312B can abut the flanges and be engaged the polishing-positioning portion 146 or the waxing-positioning portion 147.

Alternatively, the polishing-positioning portion 146 forms a ramp along the direction from the sliding portion 148 to the pull portion 145, and the waxing-positioning portion 147 forms a ramp along the direction from the sliding portion 148 to the base hole 13. The structure of the polishing-positioning portion 146, the waxing-positioning portion 147 and the sliding portion 148 are not restricted, as long as the engaging unit 14B can slide in the accommodating trough 15, and the polishing-positioning portion 146 and the waxing-positioning portion 147 can be engaged the pulling end 312B respectively to control the inserting end 311 to be inserted into the head hole 221 or not. In the third preferred embodiment, the polishing-positioning portion 146 and the waxing-positioning portion 147 are recessed in the engaging unit 14B, and the sliding portion 148 is inclined.

With reference to FIG. 6, when the waxing-positioning portion 147 engages the pulling end 312B, the end of the grinding head 22 in which the head hole 221 is defined is free for rotation, such that the stick body 31B is not fixed relative to the base 10. In this situation, the eccentric seat is applied for waxing an automobile surface.

Figure 8:
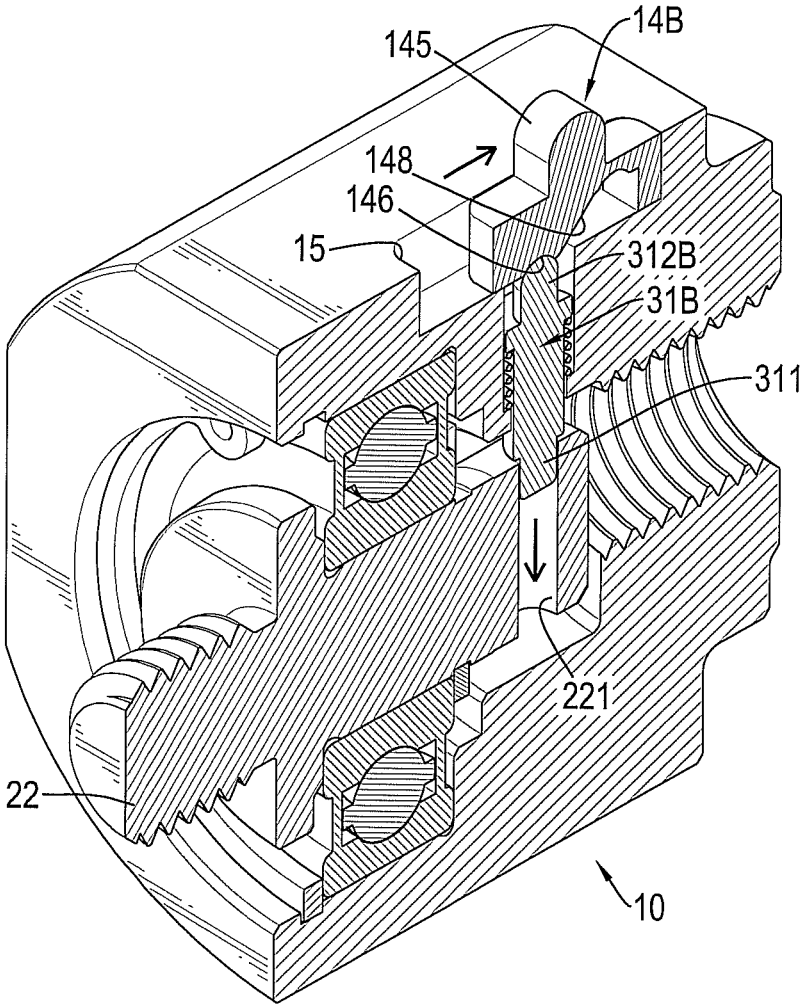
FIG. 8 is an operational perspective view in partial section of the eccentric seat in FIG. 6.
Figure 9:
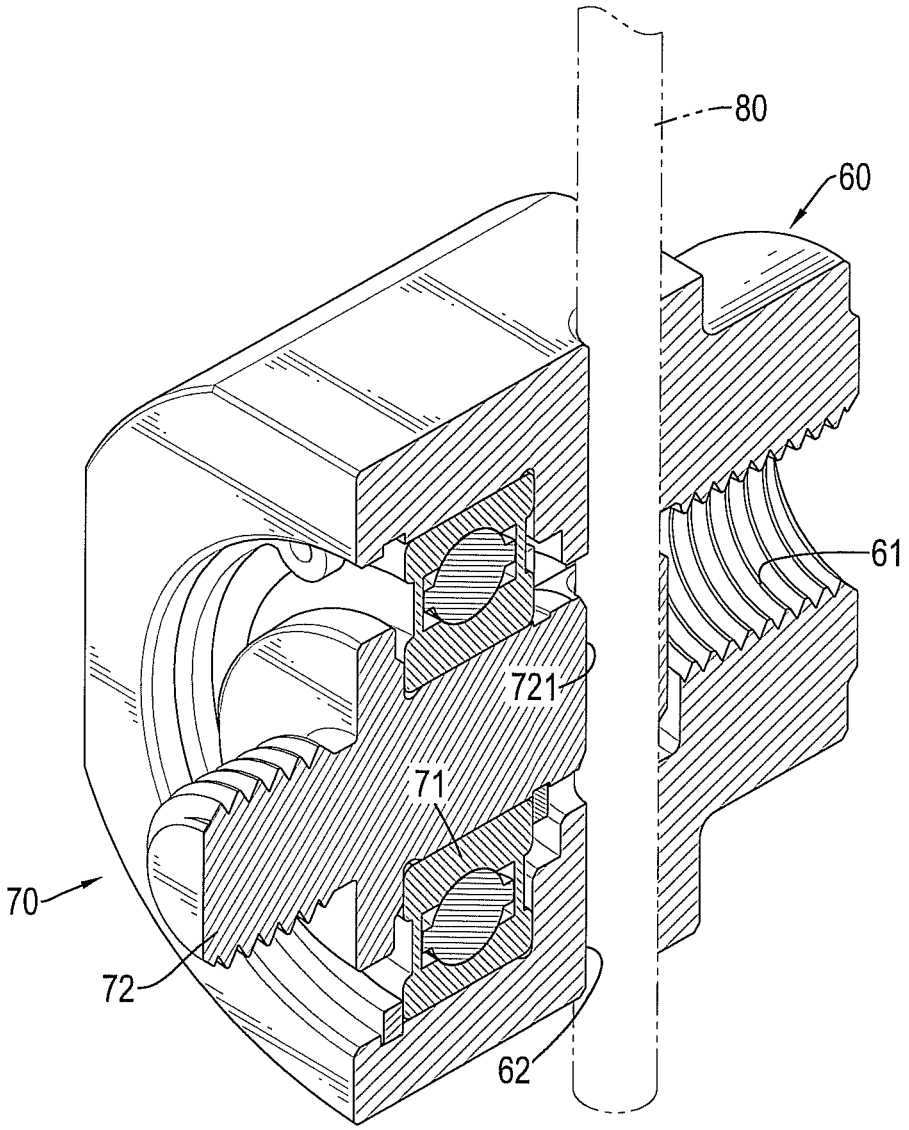
FIG.9 PRIOR ART
FIG. 9 is a perspective view in partial section of a conventional eccentric seat.

With reference to FIG. 8, when the pull portion 145 is pulled, the engaging unit 14B is accordingly moved in the accommodating trough 15 to abut the pulling end 312B by the sliding portion 148. The engaging unit 14B keeps moving until the polishing-positioning portion 146 is engaged the pulling end 312B, and then the inserting end 311 is inserted into and engages the head hole 221, such that the grinding head 22 is fixed relative to the base 10. When the base 10 rotates, the grinding head 22 is driven to rotate by the stick body 31B, and then the eccentric seat is applied for polishing an automobile or replacing different grinding bodies.

What is claimed is:

1. An eccentric seat of an automobile grinding machine comprising:

a base comprising
- a base body having a longitudinal direction;
- a base space formed along the longitudinal direction of the base body;
- a base hole formed in the base body and communicating with the base space and comprising an axial direction; and an engaging unit;

a grinding device inserted into the base space and comprising
- a bearing mounted in the base space and abutting the base body;
- a grinding head mounted in and abutting the bearing and comprising
  - an end; and
  - a head hole formed radially in the end of the grinding head and selectively aligned with the base hole;

a linking-fixing unit inserted into the base hole moveably along the axial direction of the base hole, engaged with the base and comprising
- a stick body engaging the engaging unit of the base and comprising an inserting end and a pulling end, and the pulling end and the inserting end mounted in the stick body, wherein
  - the inserting end is selectively inserted into the head hole; and
  - the pulling end is opposite to the inserting end; and
- a spring mounted around the stick body and abutting between the stick body and the base body.

2. The eccentric seat as claimed in claim 1, wherein the stick body further has a first engagement trough being elongated and formed in the stick body, and an end of the first engagement trough is adjacent to the inserting end to selectively abut the engaging unit.

3. The eccentric seat as clamed in claim 2, wherein the first engagement trough extends to the pulling end.

4. The eccentric seat as claimed in claim 3, wherein the engaging unit has
- an engaging plate abutting the base body and having a protrusion portion protruding into the base hole and selectively abutting the first engagement trough; and
- a bolt combining the engaging plate and the base body.

5. The eccentric seat as claimed in claim 2, wherein the stick body further has a second engagement trough recessed on the pulling end and selectively abutting the engaging unit, wherein a distance between the head hole and the end of the first engagement trough adjacent to the inserting end is less than a distance between the head hole and an end of the second engagement trough adjacent to the inserting end.

6. The eccentric seat as claimed in claim 3, wherein the stick body further has a second engagement trough recessed on the pulling end and selectively abutting the engaging unit, wherein a distance between the head hole and the end of the first engagement trough adjacent to the inserting end is less than a distance between the head hole and an end of the second engagement trough adjacent to the inserting end.

7. The eccentric seat as claimed in claim 4, wherein the stick body further has a second engagement trough recessed on the pulling end and selectively abutting the engaging unit, wherein a distance between the head hole and the end of the first engagement trough adjacent to the inserting end is less than a distance between the head hole and an end of the second engagement trough adjacent to the inserting end.

8. The eccentric seat as claimed in claim 1, wherein the engaging unit is slidably mounted on the base body, and has
- a side facing the stick body;
- a polishing-positioning portion located in the side of the engaging unit and selectively aligned with the base hole and pressing the pulling end;
- a waxing-positioning portion located in the side of the engaging unit and selectively aligned with the base hole and pressing the pulling end, wherein a distance between the polishing-positioning portion and the base hole is less than a distance between the waxing-positioning portion and the base hole when the polishing-positioning portion and the waxing-positioning portion are aligned with the base hole respectively; and a sliding portion located in the side of the engaging unit between the polishing-positioning portion and the waxing-positioning portion.

9. The eccentric seat as claimed in claim 8, wherein the polishing-positioning portion and the waxing-positioning portion are recessed on the engaging unit respectively.

* * * * *